US005482675A

United States Patent [19]

Shotwell et al.

[11] Patent Number: 5,482,675

[45] Date of Patent: Jan. 9, 1996

[54] CAST STEEL COMPOSITION FOR RAILWAY COMPONENTS

[75] Inventors: Hugh V. Shotwell, Hammond, Ind.; Earl K. Weber, Wheaton, Ill.; Sung C. Liu, Highland, Ind.

[73] Assignee: AMSTED Industries Incorporated, Chicago, Ill.

[21] Appl. No.: 292,511

[22] Filed: Aug. 18, 1994

[51] Int. Cl.[6] ..... C22C 38/22

[52] U.S. Cl. ..... 420/105

[58] Field of Search ..... 420/105; 148/334

[56] References Cited

U.S. PATENT DOCUMENTS

| | | | |
|---|---|---|---|
| 2,798,805 | 7/1957 | Hodge et al. | 420/105 |
| 3,155,496 | 11/1964 | Nakamaura | 420/105 |
| 3,708,280 | 1/1973 | Mimino et al. | 148/334 |

OTHER PUBLICATIONS

Metals Handbook, Eigth Edition, vol. 1 (1961, ASM Metals Parks, Ohio) pp. 7, 61, 87–94, 104–105, 124–131, 134–135 211 and 356–358.

Metals Handbook, Ninth Edition vol. 6, (1983, ASM, Metals Park, Ohio). pp. 47–48.

Association of American Railroads Manual of Standards & Recommended Practices (Ass. of American Railroads, Washington D.C. 1985) Specification M–201, pp. A–II–15 to A–II–17.

*Primary Examiner*—Deborah Yee

*Attorney, Agent, or Firm*—Brosius: Edward J.; F. S. Gregorczyk

[57] ABSTRACT

A high-strength, fine-grained, low-medium carbon steel alloy provides both the physical and chemical properties to meet AAR specifications for cast railcar components, which steel alloy has improved weldability, higher impact strength and notch toughness for such railcar components.

11 Claims, 3 Drawing Sheets

CAST STEEL COMPOSITION FOR RAILWAY COMPONENTS

BACKGROUND OF THE INVENTION

The present invention provides a steel composition. More specifically, a composition for a low-alloyed steel with a low to medium carbon content is disclosed, which steel is suitable for casting into components to meet specifications of the Association of American Railroads (AAR) for such railroad car components. This steel composition provides improved mechanical and physical properties over the compositions of steel materials currently utilized to meet these AAR railway car component specifications, as well as providing improved weldability, higher impact strength and notch toughness.

A large number of railway car components are produced under AAR specification M-201 for Grades A and B steel, which has the following composition requirements: 0.32% Carbon (maximum); 0.90% Manganese (maximum); 0.04% (maximum) Phosphorous; 0.04% (maximum) Sulfur; and, 1.50% (maximum) Silicon. Another AAR specification for railway car components, mechanical property test 7.2 (7.2.2), requires a minimum tensile strength of 70,000 psi, a minimum yield strength of 38,000 psi, an elongation in 2 inches of 24%, and a reduction in area of 36%. These specifications are largely directed to cast shapes and parts. The shapes or structures cast from such steel materials have been known to be utilized in the as-cast state, however, the cast shapes or structures are frequently normalized to produce a more uniform grain structure. In addition, these materials may have an unspecified requirement to provide weldability, as the cast shapes are frequently coupled or connected to other members by weldments.

Elevated carbon concentration in steel materials will or can interfere with their weldability. Welded members can experience "hot-cracking" at the weldment, which can result in failure and fracture. As a consequence, materials and casting suppliers provide products conforming to the above-noted AAR compositional and physical property specifications while they strive to minimize the carbon concentration in the steel material.

The mechanical strength of steel and its products can be improved by the addition of alloying elements, such as nickel, chromium, vanadium, molybdenum, boron and other alloying elements. These alloy additions must be judiciously chosen to minimize the increased costs from the alloying additions, and in consideration of the consequent change in the steel's physical and chemical properties from such additions. More specifically, the indiscriminate addition of alloying elements may positively affect some physical properties but may diminish or degrade other properties. As an example, a boron addition can increase the hardness of some steel grades, but such an addition may reduce the elongation or increase the brittleness of the steel. Other additions can be deleterious to the weldability of a steel alloy. Any alloying element addition is, or can be, costly in terms of raw material expense and added production labor costs, but further costs may be incurred from special subsequent treating or machining of products manufactured from these materials. Consequently, steel alloys may be provided to meet the requirements for a specific application, which requirements are not met by existing grades of steel, either alloy of common grades, but the alloy selection must be directed to the the desired physical and chemical characteristics for the application.

SUMMARY OF THE INVENTION

A low-alloyed, high-strength steel composition is utilized for the casting of railway car components, such as an end-sill casting. The preferred steel composition has the following percentage (by weight) chemical analysis: Carbon 0.15 to 0.21%: Manganese 0.90 to 1.30%; Silicon 0.35 to 0.65%; Chromium 0.25 to 0.60%; Molybdenum 0.10 to 0.30%; Phosphorous 0.025%(maximum); and Sulfur 0.025%(maximum) with the balance being iron (Fe) and residual components from the refining process. In the as-cast and normalized state, this material provides improved weldability and mechanical properties with minimal alloy material additions above an extant SAE steel grade 4118 or 4118H. Thus a producer of the new steel grade is not faced with the task of further complicating his alloy mixture components nor with teaching the use of new components during refining, alloy-addition or at casting. One of the benefits of producer familiarity with a similar basic steel composition is an enhanced processing rate for the manufacturer, thereby reducing the manufacturing costs. A secondary benefit accrues to the manufacturer by the avoidance of the reprocessing of scrap materials with unusual or infrequently utilized alloy additions, which scrap with an odd alloying agent would require separation and segregation of such odd alloyed materials.

In the manufacture of railway car components, the basic SAE 4118 steel grade material meets the chemical specification and the mechanical property requirements to satisfy the requisite minimal AAR M-201 Grade B mechanical and chemical specifications. However, certain applications require higher than standard strength materials, which also maintain weldability for railway component products. The present invention provides a steel composition that not only meets the AAR specification M-201 requirements for cast steel Grades A and B, but also for Grade C in the quenched and tempered state. The material composition of the present invention also has improved impact strength over extant Grade B cast steel alloys used for railway car components, as well as higher yield and tensile strengths. The improved impact properties, as demonstrated by Charpy V-notch tests, are critical for railway components, which must tolerate extremes of temperature and impact loads during operation. As well as improved strength, the composition of the present invention provides improved weldability to minimize the hot-cracking sensitivity observed in railway car components presently produced with materials having a carbon content in the range of 0.28%, which carbon content is necessary to meet the physical property requirements of the noted AAR specification M-201.

THE DRAWINGS

In the drawings, FIG. 1 is a graphical representation of the tensile and yield strengths of a quenched and tempered steel of the present alloy composition at varying tempering temperatures;

DETAILED DESCRIPTION OF THE PREFERRED EMBODIMENT

Figure 1:
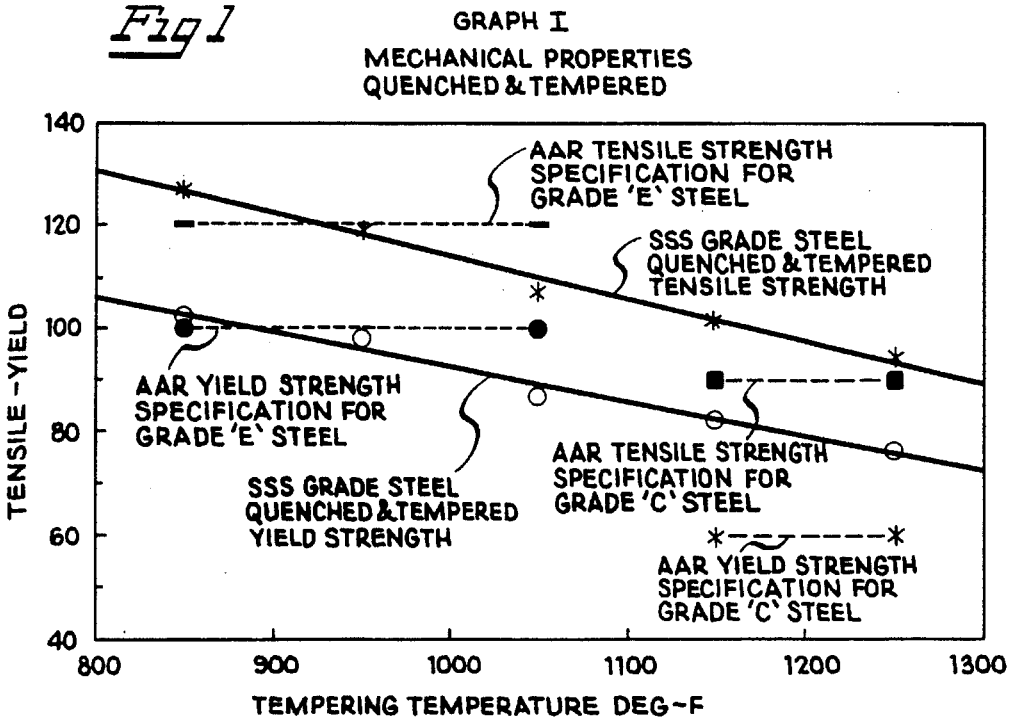
Figure 2:
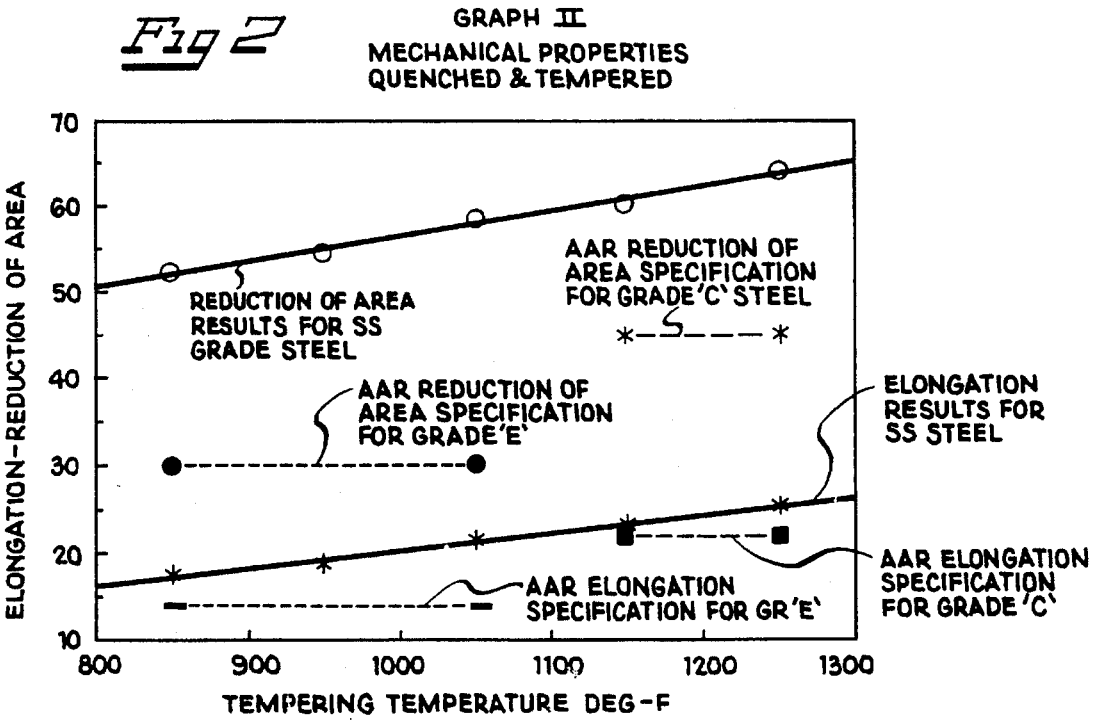
FIG. 2 is a graphical representation of the elongation and reduction of area of the tempered steels of FIG. 1.
Figure 3:
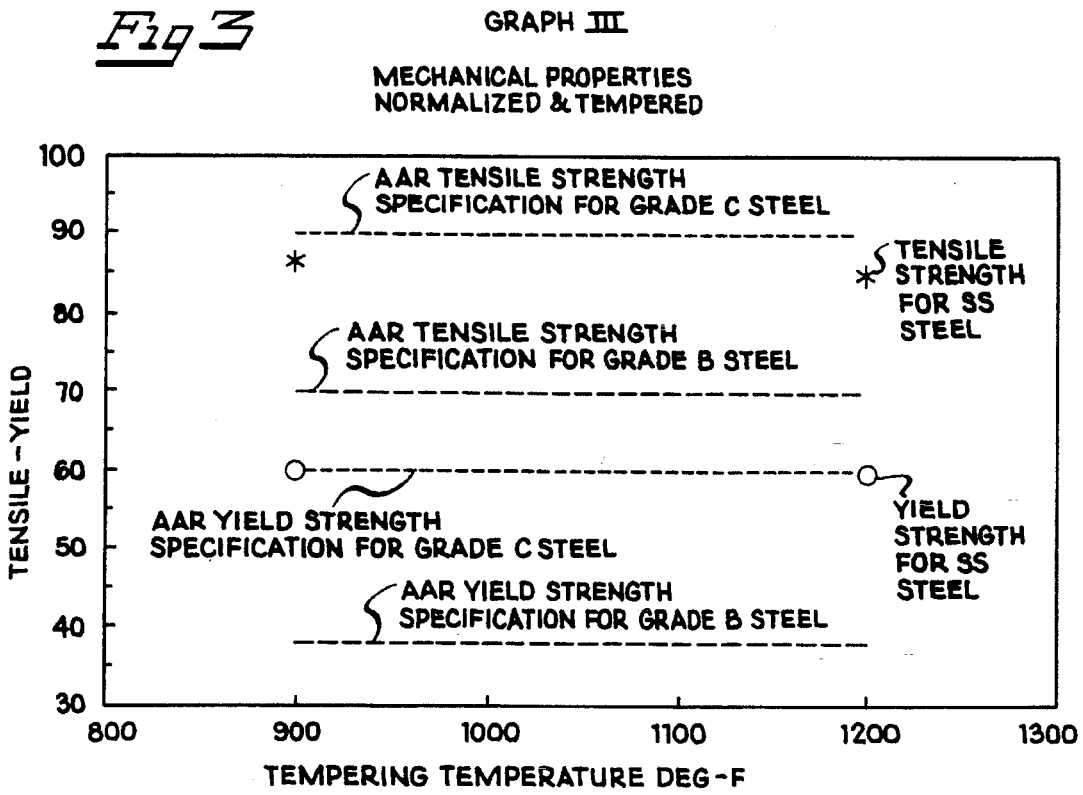
FIG. 3 is a graphical representation of the tensile and yield strengths of a normalized and tempered steel of the present alloy composition at different tempering temperatures.
Figure 4:
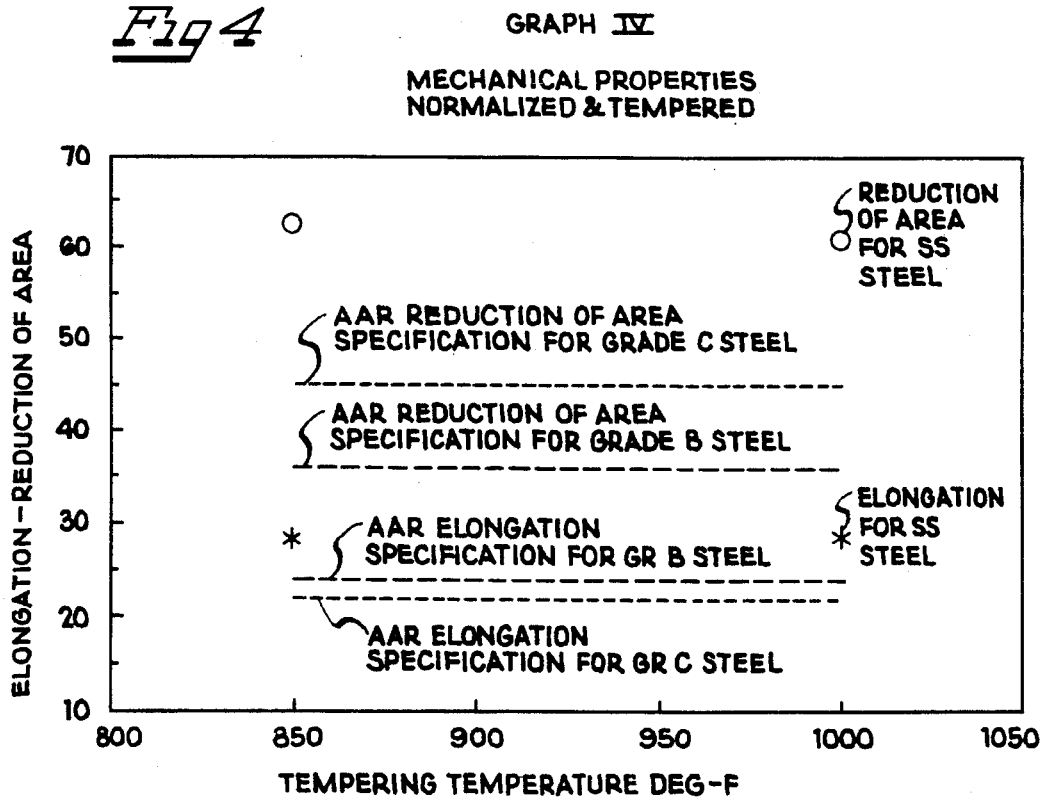
FIG. 4 is a graphical representation of the elongation and reduction of area of the tempered steels of FIG. 3.

Railway products and components, such as end sills, trucks, bolsters, connectors and couplers, are subject to meeting the physical and chemical property specifications enumerated by customers and also the Association of American Railroads (AAR). Although these AAR specifications may vary from the American Society for Testing Materials, the ASTM, or the Society of Automotive Engineers, the SAE, specifications for materials, they will generally fall within a broad class of materials noted by these accrediting societies. The reasons for the variations in the material and property specifications between the accrediting groups are pragmatic and historical product developments, which resulted in the evolution of the individual product specifications.

The AAR is comprised of railroad industry personnel intimately familiar with the specific product needs of the railroad industry. The AAR promulgates standards and specifications consistent with the needs of the railroad industry. Indicative of the variation between the SAE, Society of Automotive Engineers, and the AAR is the magnitude and composition of the cast products of concern to the different parties. As an example, the SAE would be particularly interested in the chemical and physical properties of gray iron or nodular iron castings, and the largest-mass product of their concern might possibly be an engine block for a car. However, the AAR is more frequently interested in large steel castings, such as for railroad wheels and railway car trucks, bolsters and couplers, which have different property requirements, than the iron castings more frequently used in the automotive industry. There is a significant difference between iron castings, which may have a carbon concentration above 3 percent, and castings of steel, which is generally regarded as an iron alloy with less than 1.2 percent carbon.

The improved steel alloy composition for cast steel railway components is broadly encompassed by the classification for Grade B steel of AAR specification M-201 paragraph (6.1). The following table shows the chemical composition specification for the M-201 Grades A, B, and C in Table I:

TABLE I

| Grade | C | Mn | Si | P | S | Cr | Mo |
|---|---|---|---|---|---|---|---|
| A | 0.32 mx | 0.90 mx | 1.50 mx | 0.04 mx | 0.04 mx | — | — |
| B | 0.32 mx | 0.90 mx | 1.50 mx | 0.04 mx | 0.04 mx | — | — |
| C | 0.32 mx | 1.85 mx | 1.50 mx | 0.04 mx | 0.04 mx | — | — |

This same AAR specification for Grades A and B, M-201 at paragraph 6.1.1, permits an increase of 0.04 percent manganese above the specified maximum, up to a maximum of 1.20 percent of manganese, for each reduction of 0.01 percent carbon below the specified maximum carbon percentage.

The mechanical properties specified by the AAR for steel castings for above-noted steel Grades A, B, and C are noted in the following Table II:

TABLE II

| | Grade A | | | |
|---|---|---|---|---|
| | Unannealed | Annealed or Normalized | Grade B | Grade C |
| Tensile Strength, (psi) | 60,000 | 60,000 | 70,000 | 90,000 |
| Yield Point (psi) | 30,000 | 30,000 | 38,000 | 60,000 |
| Elongation in 2", % | 22 | 26 | 24 | 22 |
| Reduction of Area, % | 30 | 38 | 36 | 45 |

Although these properties are attainable with current alloy manufacturing technology and can consequently be met without extreme efforts, they have been determined to be the minimally tolerable requirements for the railway parts, assemblies and components manufactured under the AAR specifications.

The attainment of the requisite material mechanical properties is coupled to the constituent alloy components, more particularly to the carbon or carbon equivalent level. Among the methods utilized to calculate the carbon equivalent for ferrous alloys are the equations provided at page 7, Volume 1 of the Metals Handbook of the American Society for Metals. The first equation is provided for gray iron, and is an empirical relationship of the total carbon, silicon and phosphorous content expressed as the carbon equivalent (CE)

$$CE=\%\text{total carbon } (TC)+0.3(\%Si+\%P)$$

Another and similar relationship for malleable iron is $$CE=\%C+\%Si.$$

Although these equations do not precisely define the exact relationship between the alloying materials and their substitution by carbon, they have been found to provide the manufacturer and engineer with a good working approximation for the expected consequence of the various relative alloy element concentrations.

The manufacture of the aforementioned railway components frequently entails welding and welding practices. As discussed at the above-noted Metals Handbook at page 93, " . . . higher alloy content of these steels results in some degree of hardening of the weld heat-affected zone, . . . ". In addition, excess hydrogen in welds on these steels can result in underbead cracking, which may be attributable to the addition of stresses. For cast steels utilized in the manufacture of railway components, it has been found that incidences of cold cracking under a weld bead can be controlled or minimized by maintaining a carbon equivalent (CE) less than or equal to 0.4 based upon the following equation:

$$CE=\%C+(\%Mn/6)+(\%Ni/20)+(\%Cr/10)+(\%Cu/40)-(\%Mo/50)-(\%V/10)$$

The imprecision of the above equation is apparent in view of the interrelationships in any particular ferrous alloy material between the several elements and any residual elements, as well as the process utilized to manufacture the alloy. However, as a relative predictive tool and target-setting parameter for the manufacturer and the engineer, such equations serve an indispensable purpose in the manufacture and use of materials, and their use has found wide acceptance in the ferrous industry.

Hot shortness or hot-cracking in a metal is exhibited by brittleness in the hot forming range. In addition to meeting the above-identified AAR specifications and having a carbon equivalent in the requisite specification range, a cast steel alloy material for utilization on railway components should exhibit resistance to hot-cracking.

Indicative of this "hot cracking" resistance is a coefficient or constant of hot-cracking sensitivity, HCS, which may be described as a ratio of the component concentrations expressed in weight percent as follows:

$$HCS=(\%C)(1000)[\%S+\%P+(\%Si/25)+(\%Ni/100)]/[3(\%Mn)+\%Cr+\%Mo+\%V]$$

It has been noted that when this value of HCS is less than or equal to 4.0 the ferrous material exhibits good resistance to hot cracking. The disclosed material of the present invention provides an HCS coefficient, as defined by the above equation, which has a specification range of 1.2 to 3.1, and thus is felt to provide a material that is relatively resistant to hot-cracking.

Tests and test results for sample heats of the alloy of the present invention, which is nominated as SS-Steel, as well as the associated alloy composition are illustrated in the following tables and charts: (1) Tables III to X; and, Charts I to VII in FIGS. 1 to 7.

TABLE III

| | CHEMICAL ANALYSIS OF SS-STEEL SAMPLE HEATS | | | | | | | | | | | | |
|---|---|---|---|---|---|---|---|---|---|---|---|---|---|
| Heat No. | C | Mn | Si | P | S | Cr | Mo | Ni* | Cu* | V* | Al | CE | HCS |
| Aim | 0.18 | 1.2 | 0.57 | .025 max | .025 max | 0.32 | 0.12 | | | | | | |
| Spec. Range | .16/.21 | 1.10/1.30 | .50/.65 | .025 max | .025 max | .25/.38 | .10/.15 | | | | | | |
| 6854 | 0.18 | 1.12 | 0.48 | 0.014 | 0.006 | 0.33 | 0.12 | 0.02 | 0.02 | 0.004 | 0.04 | 0.398367 | 1.859465 |
| 6857 | 0.17 | 1.1 | 0.45 | 0.015 | 0.006 | 0.34 | 0.1 | 0.02 | 0.02 | 0.004 | 0.04 | 0.386433 | 1.779915 |
| 6859 | 0.19 | 1.25 | 0.59 | 0.014 | 0.006 | 0.33 | 0.12 | 0.02 | 0.02 | 0.004 | 0.04 | 0.430033 | 1.979543 |
| 6861 | 0.21 | 1.17 | 0.51 | 0.013 | 0.006 | 0.28 | 0.1 | 0.02 | 0.02 | 0.003 | 0.04 | 0.4322 | 2.136142 |
| 6865 | 0.19 | 1.25 | 0.59 | 0.013 | 0.009 | 0.29 | 0.1 | 0.02 | 0.03 | 0.004 | 0.05 | 0.426683 | 2.099903 |
| 6868 | 0.21 | 1.25 | 0.54 | 0.012 | 0.007 | 0.3 | 0.11 | 0.03 | 0.03 | 0.004 | 0.04 | 0.447983 | 2.06268 |
| 6869 | 0.21 | 1.22 | 0.61 | 0.012 | 0.008 | 0.34 | 0.15 | 0.03 | 0.03 | 0.004 | 0.05 | 0.446183 | 2.25975 |
| 6870 | 0.2 | 1.05 | 0.49 | 0.01 | 0.008 | 0.3 | 0.11 | 0.03 | 0.02 | 0.003 | 0.05 | 0.4045 | 2.127421 |
| 6890 | 0.18 | 1.15 | 0.6 | 0.015 | 0.009 | 0.29 | 0.13 | 0.03 | 0.02 | 0.004 | 0.04 | 0.399667 | 2.244192 |
| 6891 | 0.17 | 1.23 | 0.66 | 0.014 | 0.007 | 0.32 | 0.14 | 0.03 | 0.02 | 0.004 | 0.05 | 0.4058 | 1.952094 |

*Residual

TABLE IV

| Harden at 1650° F. for 1 Hour<br>Water Quench<br>Temper at 850° F. for 2 Hours<br>Air Cool<br>Heat No. | 6854 | 5857 | 6859 | 6861 | 6865 | 6868 | 6869 | 6870 | 6890 | 6891 | x-Bar |
|---|---|---|---|---|---|---|---|---|---|---|---|
| Yield Strength | 100.0 | 94.0 | 107.0 | 103.5 | 98.0 | 111.5 | 117.0 | 101.0 | 98.0 | 99.0 | 102.3 |
| (lbs/in$^2$ × 1000) | 102.5 | 88.5 | 106.5 | 98.0 | 98.5 | 111.0 | 112.5 | 100.0 | 98.5 | 102 | 7 |
| Tensile Strength | 125.0 | 116.0 | 130.5 | 127.5 | 126.0 | 133.5 | 140.0 | 124.5 | 124.5 | 124.8 | 126.6 |
| (lbs/in$^2$ × 1000) | 125.5 | 113.5 | 129.0 | 124.5 | 124.0 | 134.0 | 136.0 | 124.0 | 123.5 | 126.5 | 4 |
| Elongation | 18.0 | 20.0 | 17.0 | 17.0 | 17.0 | 15.0 | 15.5 | 17.5 | 19.0 | 18.0 | 17.45 |
| % Change | 18.0 | 19.0 | 16.5 | 17.5 | 17.0 | 16.0 | 16.5 | 17.5 | 18.5 | 18.5 | |
| Reduction of | 53.0 | 57.5 | 46.6 | 51.4 | 61.6 | 50.6 | 48.6 | 53.3 | 51.4 | 56.5 | 52.28 |
| Area (%) | 55.2 | 56.8 | 51.4 | 52.2 | 50.0 | 51.1 | 46.0 | 47.2 | 51.9 | 53.3 | |
| Charpy V-Notch | 18 | 21 | 16 | 17 | 20 | 16 | 15 | 15 | 14 | 12 | 16.47 |
| @−40° F. (Ft- | 19 | 21 | 16 | 19 | 19 | 15 | 15 | 16 | 12 | 15 | |
| lbs) | 19 | 20 | 14 | 17 | 20 | 17 | 14 | 16 | 15 | 12 | |
| | 17 | 23 | 16 | 18 | 18 | 17 | 14 | 17 | 13 | 11 | |
| × (Av.) | 18.3 | 21.3 | 15.5 | 17.8 | 19.3 | 16.3 | 14.5 | 16.0 | 13.5 | 12.5 | |
| Brinell Hardness (BHN) | 302–286 | 217–235 | 255–262 | 286–293 | 293–293 | 293–302 | 286–302 | 286–255 | 241–255 | 255–255 | |

TABLE V

| Harden at 1650° F. for 1 Hour<br>Water Quench<br>Temper at 950° F. for 2 Hours<br>Air Cool<br>Heat No. | 6854 | 5857 | 6859 | 6861 | 6865 | 6868 | 6869 | 6870 | 6890 | 6891 | x-Bar |
|---|---|---|---|---|---|---|---|---|---|---|---|
| Yield Strength | 93.0 | 95.5 | 97.5 | 97.0 | 94.5 | 101.0 | 112.5 | 98.0 | 95.0 | 100.0 | 98.12 |
| (lbs/in$^2$ × 1000) | 95.5 | 85.0 | 100.5 | 93.5 | 93.5 | 103.5 | 109.5 | 102.5 | 96.5 | 99.0 | |
| Tensile Strength | 115.0 | 129.5 | 119.5 | 118.0 | 116.5 | 122.0 | 131.5 | 117.5 | 115.0 | 119.0 | 119.1 |
| (lbs/in$^2$ × 1000) | 116.0 | 105.0 | 120.5 | 116.0 | 115.0 | 123.0 | 128.5 | 120.5 | 116.0 | 118.5 | 2 |
| Elongation | 18.5 | 15.0 | 17.0 | 20.5 | 19.5 | 19.5 | 17.5 | 19.0 | 12.5* | 19.0 | 18.84 |
| % Change | 19.0 | 21.5 | 19.5 | 19.5 | 19.5 | 19.0 | 17.5 | 18.0 | 19.0 | 20.0 | |
| Reduction of | 57.0 | 37.0 | 42.8 | 55.7 | 53.3 | 54.4 | 50.8 | 54.1 | 25.1* | 56.5 | 54.31 |
| Area (%) | 55.7 | 59.8 | 56.0 | 53.3 | 56.2 | 55.5 | 51.1 | 49.8 | 56.8 | 58.8 | |
| | | | | | | | | | | 53.3 | |
| Charpy V-Notch | 26 | 16 | 30 | 27 | 25 | 25 | 21 | 27 | 20 | 27 | 24.60 |
| @−40° F. (Ft- | 27 | 34 | 22 | 30 | 24 | 28 | 20 | 28 | 21 | 23 | |
| lbs) | 28 | 34 | 23 | 29 | 25 | 21 | 21 | 30 | 24 | 21 | |
| | 25 | 14 | 26 | 28 | 26 | 23 | 17 | 26 | 19 | 23 | |
| × (Av.) | 26.5 | 24.5 | 25.3 | 28.5 | 25.0 | 24.3 | 19.8 | 25.3 | 21.0 | 23.5 | |
| Brinell Hardness (BHN) | 241–255 | 212–302[1] | 255–255 | 235–241 | 228–241 | 269–269 | 286–286 | 255–255 | 235–262 | 241–241 | |

*Test Flawed
[1]3 Test Points

25

TABLE VI

| Harden at 1650° F. for 1 Hour<br>Water Quench<br>Temper at 1050° F. for 2 Hours<br>Air Cool<br>Heat No. | 6854 | 5857 | 6859 | 6861 | 6865 | 6868 | 6869 | 6870 | 6890 | 6891 | x-Bar |
|---|---|---|---|---|---|---|---|---|---|---|---|
| Yield Strength | 85.0 | 78.5 | 91.5 | 84.0 | 84.0 | 92.5 | 94.0 | 86.5 | 84.0 | 87.0 | 88.82 |
| (lbs/in$^2$ × 1000) | 85.5 | 78.0 | 92.5 | 85.0 | 84.5 | 89.5 | 94.5 | 87.5 | 85.0 | 87.5 | |
| Tensile Strength | 104.5 | 97.0 | 111.5 | 105.5 | 103.5 | 113.0 | 115.0 | 107.0 | 106.0 | 108.5 | 107.2 |
| (lbs/in$^2$ × 1000) | 105.0 | 97.5 | 112.5 | 106.0 | 103.0 | 110.5 | 116.0 | 108.0 | 106.5 | 108.0 | 2 |
| Elongation | 24.0 | 23.5 | 21.5 | 21.0 | 21.5 | 21.0 | 19.5 | 21.5 | 20.5 | 21.5 | 21.52 |
| % Change | 23.0 | 23.5 | 22.0 | 21.5 | 21.0 | 21.0 | 19.5 | 20.5 | 21.5 | 21.5 | |
| Reduction of | 61.1 | 60.8 | 57.5 | 51.9 | 60.1 | 57.8 | 59.4 | 59.1 | 56.8 | 59.8 | 58.69 |
| Area (%) | 60.8 | 61.8 | 59.8 | 58.3 | 58.1 | 57.5 | 56.2 | 57.8 | 58.1 | 61.1 | |
| Charpy V-Notch | 35 | 40 | 34 | 33 | 31 | 32 | 27 | 35 | 30 | 28 | 31.82 |
| @−40° F. (Ft- | 41 | 36 | 31 | 28 | 28 | 28 | 26 | 33 | 28 | 25 | |
| lbs) | 36 | 41 | 36 | 35 | 28 | 33 | 28 | 32 | 33 | 28 | |
| | 35 | 39 | 30 | 33 | 31 | 28 | 30 | 29 | 32 | 27 | |
| × (Av.) | 36.8 | 39.0 | 32.8 | 32.3 | 29.5 | 30.3 | 27.8 | 32.3 | 30.8 | 27.0 | |
| Brinell Hardness (BHN) | 212–217 | 179–183 | 233–228 | 212–223 | 207–217 | 223–235 | 235–241 | 217–223 | 207–207 | 207–217 | |

TABLE VII

| Harden at 1650° F. for 1 Hour<br>Water Quench<br>Temper at 1150° F. for 2 Hours<br>Air Cool<br>Heat No. | 6854 | 5857 | 6859 | 6861 | 6865 | 6868 | 6869 | 6870 | 6890 | 6891 | x-Bar |
|---|---|---|---|---|---|---|---|---|---|---|---|
| Yield Strength | 81.5 | 75.0 | 81.5 | 85.0 | 81.5 | 82.0 | 89.0 | 81.5 | 81.0 | 85.0 | 82.22 |
| (lbs/in$^2$ × 1000) | 78.5 | 72.5 | 87.0 | 80.5 | 84.0 | 81.5 | 89.5 | 82.0 | 82.0 | 84.0 | |
| Tensile Strength | 100.5 | 94.0 | 101.5 | 103.0 | 100.5 | 102.5 | 109.5 | 101.5 | 102.0 | 103.0 | 101.8 |
| (lbs/in$^2$ × 1000) | 98.5 | 93.0 | 105.5 | 101.0 | 101.5 | 103.0 | 109.0 | 102.5 | 101.0 | 103.5 | 2 |
| Elongation | 23.5 | 25.0 | 24.0 | 23.5 | 24.0 | 22.0 | 21.5 | 23.5 | 22.5 | 23.0 | 23.22 |
| % Change | 24.5 | 24.0 | 23.0 | 24.0 | 23.5 | 21.5 | 22.0 | 24.5 | 22.5 | 22.5 | |
| Reduction of | 60.1 | 64.7 | 59.1 | 60.8 | 63.0 | 52.8 | 56.2 | 60.3 | 61.1 | 63.3 | 60.19 |
| Area (%) | 61.3 | 63.3 | 59.4 | 59.8 | 58.3 | 55.2 | 59.6 | 62.6 | 60.1 | 62.8 | |
| Charpy V-Notch | 37 | 41 | 41 | 42 | 42 | 36 | 30 | 36 | 26 | 35 | 38.10 |

TABLE VII-continued

| Harden at 1650° F. for 1 Hour<br>Water Quench<br>Temper at 1150° F. for 2 Hours<br>Air Cool<br>Heat No. | 6854 | 5857 | 6859 | 6861 | 6865 | 6868 | 6869 | 6870 | 6890 | 6891 | x-Bar |
|---|---|---|---|---|---|---|---|---|---|---|---|
| @−40° F. (Ft- | 34 | 52 | 41 | 39 | 44 | 36 | 31 | 37 | 34 | 36 | |
| lbs) | 36 | 60 | 38 | 46 | 38 | 33 | 34 | 29 | 32 | 41 | |
| | 40 | 47 | 37 | 43 | 35 | 32 | 37 | 40 | 34 | 42 | |
| × (Av.) | 36.8 | 50.0 | 39.3 | 42.5 | 39.8 | 34.3 | 33.0 | 35.5 | 31.5 | 38.5 | |
| Brinell Hardness (BHN) | 196–207 | 179–187 | 207–217 | 207–212 | 196–217 | 202–207 | 217–217 | 196–196 | 187–196 | 207–207 | |

TABLE VIII

| Harden at 1650° F. for 1 Hour<br>Water Quench<br>Temper at 1250° F. for 2 Hours<br>Air Cool<br>Heat No. | 6854 | 5857 | 6859 | 6861 | 6865 | 6868 | 6869 | 6870 | 6890 | 6891 | x-Bar |
|---|---|---|---|---|---|---|---|---|---|---|---|
| Yield Strength | 76.5 | 71.0 | 79.5 | 77.0 | 74.0 | 80.0 | 80.0 | 75.5 | 75.0 | 79.0 | 76.29 |
| (lbs/in$^2$ × 1000) | 76.0 | 71.5 | 77.5 | 74.5 | 76.0 | 74.5 | 80.5 | 76.0 | N/A | 75.5 | |
| Tensile Strength | 94.0 | 88.5 | 98.0 | 95.0 | 93.0 | 99.5 | 99.0 | 93.0 | 91.5 | 95.5 | 94.37 |
| (lbs/in$^2$ × 1000) | 92.0 | 89.0 | 96.5 | 93.5 | 92.5 | 96.5 | 98.5 | 92.5 | N/A | 95.0 | |
| Elongation | 26.0 | 27.0 | 25.5 | 25.5 | 26.0 | 25.0 | 25.0 | 25.0 | 25.0 | 25.5 | 25.39 |
| % Change | 27.0 | 26.5 | 25.5 | 24.5 | 25.5 | 23.0 | 25.0 | 24.5 | N/A | 25.5 | |
| Reduction of | 67.0 | 69.0 | 64.2 | 64.2 | 63.3 | 62.3 | 63.8 | 65.6 | 63.8 | 67.5 | 64.22 |
| Area (%) | 67.3 | 67.7 | 64.0 | 62.3 | 64.4 | 49.2 | 62.3 | 65.2 | N/A | 67.0 | |
| Charpy V-Notch | 54 | 58 | 41 | 38 | 52 | 45 | 38 | 42 | 39 | 44 | 45.45 |
| @−40° F. (Ft- | 53 | 59 | 42 | 40 | 50 | 51 | 41 | 45 | 42 | 45 | |
| lbs) | 53 | 52 | 45 | 42 | 44 | 44 | 41 | 41 | 41 | 42 | |
| | 51 | 57 | 40 | 43 | 41 | 46 | 42 | 44 | 42 | 48 | |
| × (Av.) | 52.8 | 56.5 | 42.0 | 40.8 | 46.8 | 46.5 | 40.5 | 43.0 | 41.0 | 44.8 | |
| Brinell Hardness (BHN) | 179–179 | 174–174 | 187–187 | 179–179 | 179–179 | 179–179 | 192–187 | 179–179 | 174–179 | 183–183 | |

TABLE IX

| Normalize at 1650° F. for 1 Hour<br>Air Cool<br>Temper at 850° F. for 2 Hours<br>Air Cool<br>Heat No. | 6854 | 5857 | 6859 | 6861 | 6865 | 6868 | 6869 | 6870 | 6890 | 6891 | x-Bar |
|---|---|---|---|---|---|---|---|---|---|---|---|
| Yield Strength | 57.0 | 56.5 | 64.0 | 58.0 | 61.5 | 62.0 | 62.5 | 58.0 | 59.5 | 61.5 | 59.77 |
| (lbs/in$^2$ × 1000) | 58.0 | 54.0 | 61.0 | 60.0 | 58.0 | 63.5 | 64.0 | 57.5 | 58.5 | 60.0 | |
| Tensile Strength | 84.0 | 79.5 | 91.0 | 85.5 | 87.5 | 89.5 | 93.0 | 83.0 | 85.0 | 89.0 | 86.34 |
| (lbs/in$^2$ × 1000) | 83.5 | 78.5 | 90.5 | 86.5 | 87.0 | N/A | 92.0 | 82.5 | 84.0 | 89.0 | |
| Elongation | 29.0 | 31.5 | 28.5 | 28.0 | 28.0 | 27.5 | 26.0 | 29.0 | 28.0 | 26.5 | 28.25 |
| % Change | 30.0 | 31.5 | 27.5 | 28.5 | 29.0 | 27.5 | 25.5 | 29.0 | 28.0 | 26.5 | |
| Reduction of | 65.9 | 69.5 | 61.6 | 59.8 | 61.8 | 62.3 | 58.8 | 64.9 | 59.1 | 58.8 | 62.63 |
| Area (%) | 65.9 | 69.0 | 61.8 | 64.2 | 61.6 | 60.1 | 58.3 | 63.3 | 64.2 | 61.8 | |
| Charpy V-Notch | 34 | 56 | 30 | 35 | 27 | 30 | 24 | 35 | 25 | 28 | 32.9 |
| @−0° F. (Ft- | 32 | 52 | 28 | 34 | 32 | 32 | 25 | 31 | 30 | 34 | |
| lbs) | 31 | 57 | 27 | 29 | 35 | 30 | 27 | 32 | 26 | 29 | |
| | 34 | 53 | 29 | 35 | 36 | 31 | 26 | 33 | 31 | 30 | |
| × (Av.) | 32.3 | 54.5 | 28.5 | 33.3 | 32.5 | 30.8 | 25.5 | 32.8 | 28.0 | 30.3 | |
| Brinell Hardness (BHN) | 153–153 | 137–137 | 170–170 | 149–153 | 153–156 | 163–163 | 170–170 | 149–149 | 156–156 | 163–163 | |

TABLE X

| Normalize at 1650° F. for 1 Hour Air Cool Temper at 1000° F. for 2 Hours Air Cool Heat No. | 6854 | 5857 | 6859 | 6861 | 6865 | 6868 | 6869 | 6870 | 6890 | 6891 | x-Bar |
|---|---|---|---|---|---|---|---|---|---|---|---|
| Yield Strength | 58.0 | 51.5 | 61.0 | 57.0 | 62.0 | 60.0 | 66.0 | 55.0 | 57.0 | 60.5 | 59.05 |
| (lbs/in$^2$ × 1000) | 58.5 | 52.0 | 62.5 | 58.0 | 58.5 | 62.0 | 65.0 | 57.5 | 60.0 | 59.0 | |
| Tensile Strength | 82.5 | 77.5 | 88.5 | 85.0 | 86.0 | 88.0 | 90.5 | 82.0 | 84.5 | 86.0 | 84.80 |
| (lbs/in$^2$ × 1000) | 82.0 | 78.0 | 88.0 | 84.5 | 84.5 | 87.5 | 90.0 | 82.5 | 83.5 | 85.0 | |
| Elongation | 28.0 | 30.0 | 28.0 | 31.0 | 28.5 | 28.5 | 25.0 | 30.5 | 28.5 | 29.0 | 28.65 |
| % Change | 28.5 | 31.5 | 27.5 | 29.5 | 29.0 | 25.0 | 26.0 | 30.5 | 30.0 | 28.5 | |
| Reduction of | 57.8 | 67.5 | 61.3 | 66.1 | 59.6 | 59.4 | 54.9 | 61.6 | 61.8 | 59.8 | 61.02 |
| Area (%) | 60.3 | 68.6 | 59.8 | 65.6 | 63.3 | 48.9 | 57.5 | 64.4 | 65.2 | 57.0 | |
| Charpy V-Notch | 36 | 46 | 28 | 38 | 28 | 26 | 28 | 35 | 27 | 34 | 32.9 |
| @−0° F. (Ft- | 34 | 45 | 31 | 36 | 34 | 26 | 23 | 29 | 28 | 37 | |
| lbs) | 35 | 46 | 25 | 32 | 35 | 27 | 25 | 34 | 34 | 35 | |
| | 35 | 48 | 33 | 34 | 33 | 27 | 27 | 33 | 32 | 38 | |
| × (Av.) | 35.0 | 46.3 | 29.3 | 35.0 | 32.5 | 26.5 | 25.8 | 32.8 | 30.3 | 36.0 | |
| Brinell Hardness (BHN) | 149–149 | 140–143 | 163–159 | 149–149 | 149–149 | 156–156 | 163–163 | 143–149 | 149–156 | 156–159 | |

Table III lists the chemical analysis of the alloy of the present invention, which is noted as the "AIM", as well as the specification range for the alloy elements and the chemical analyses for ten (10) test heats of the steel composition of the present invention, noted as SS steel, as well as the specification ranges and the preferred analysis. These several steel heats were poured into molds and the products were heat-treated and tempered under varying conditions. More specifically, the sample castings from each heat were separated and treated in the following manners: (A) Hardened at 1650° F. for one (1) hour, water quenched and tempered at 850° F. for two (2) hours, and allowed to air cool; (B) Hardened at 1650° F. for one (1) hour, water quenched and tempered at 950° F. for two (2) hours, and allowed to air cool; (C) Hardened at 1650° F. for one (1) hour, water quenched and tempered at 1050° F. for two (2) hours, and allowed to air cool; (D) Hardened at 1650° F. for one (1) hour, water quenched and tempered at 1150° F. for two (2) hours, and allowed to air cool; (E) Hardened at 1650° F. for one (1) hour, water quenched and tempered at 1250° F. for two (2) hours, and allowed to air cool; (F) Normalized at 1650° F. for one (1) hour, air cooled and tempered at 850° F. for two (2) hours, and allowed to air cool; and, (G) Normalized at 1650° F. for one (1) hour, air cooled and tempered at 1000° F. for two (2) hours, and allowed to air cool. Subsequently, tests were performed on the heat-treated cast samples for yield strength, tensile strength, elongation, reduction of area, toughness (Charpy V-notch), and hardness. The test results for each steel heat (melt) and each heat-treating practice are noted in the respective Tables IV through X. For ease of analysis, graphical plotting and consideration, the test values are reported as averages (x-bar) in the right-hand column of each of the listed Tables IV to X.

These average values are considered representative of the data and provided the data values for plotting in the attached charts and graphs I to V. In Tables IV to VIII, the average yield strengths for the quenched and tempered alloy samples ranged between 102,370 psi and 76,290 psi in comparison to the AAR M-201 Grade B specification of 38,000 psi minimum. Similarly the average tensile strengths for these same tests ranged between 126,640 psi and 94,370 psi versus the requisite minimum of 70,000 psi. The reported average values for the normalized and tempered samples were 59,770 and 59050 psi yield strengths and 86,340 and 84,800 psi for the tensile strengths. In FIG. 1, Graph I, the tensile and yield strengths are plotted for the reported average results from Tables IV to VIII for the SS-steel along with the specified tensile and yield strengths for M-201 grades C and E as reference conditions. As noted in Graph I, the tensile and yield strengths for the SS-steel decrease as the tempering temperature is increased, which is not an unusual condition, and is consistent with the results for other steel products. The Grades C and E mechanical property specification values were utilized as the reference conditions for the graphed values, as these conditions are more stringent than the values for the Grade B, which values for Grade B are implicitly met by virtue of having met the more stringent specifications.

It is clear that the tensile and yield strengths of the SS-steel in the quenched and tempered state, as plotted in Graph I, are consistently above the specified requirements for M-201 Grade C steel, and at the lower tempering temperatures the tensile and yield strengths exceed the requirements for the M-201 Grade E steel. Further, in FIG. 2, Graph II illustrates the expected improvement in the elongation and reduction of area for steels generally as the tempering temperature increases, and as shown, the SS-steel characteristics for these parameters exceed the requirements for both the M-201 Grades C and E across the noted temperature ranges.

The graphical illustrations of the mechanical property test results for the normalized and tempered SS-steel samples are noted in Graphs III and IV, but there are only two resultant data points available for these graphs. As shown in Graph III, the mechanical property specification requirements for M-201 Grades B and C are plotted as reference characteristics and the reported yield strength results for the SS-steel greatly exceeds the requirements for the Grade B material and meets the requirements for the Grade C material. The tensile strength of the SS-steel also exceeds the specification requirement for the Grade B material, but the tensile strength is about two (2) percent below the requirement for the Grade C material. The elongation and reduction of area results for the SS-steel clearly exceed the specification requirements for both Grades B and C throughout the reported tempering temperature ranges, as clearly illustrated in FIG. 4.

Figure 5:
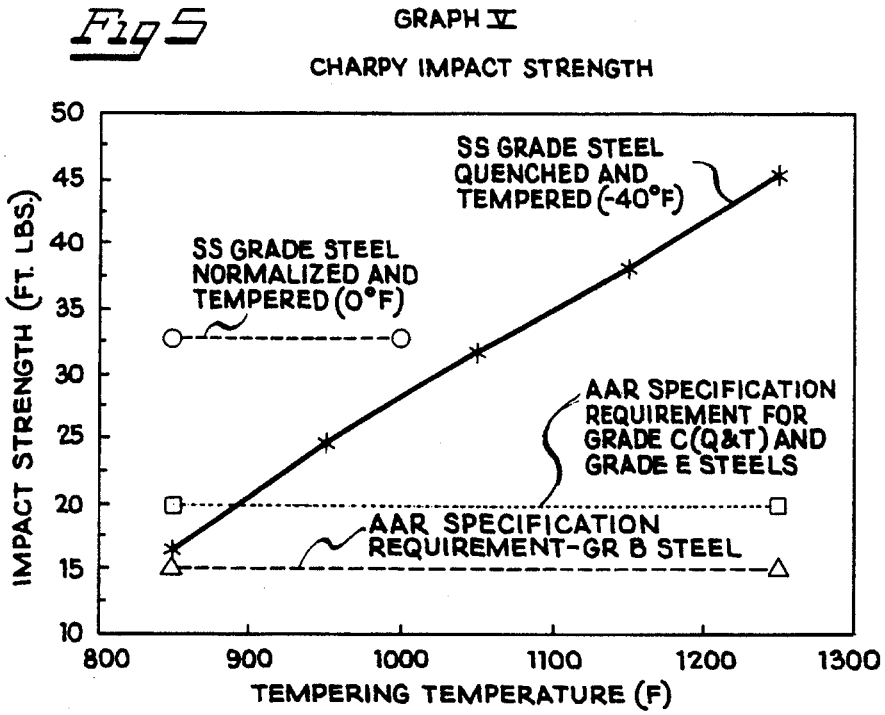
FIG. 5 is a graphical illustration of the Charpy V-Notch impact strength of the tempered steel samples of FIGS. 1 to 4.
Figure 6:
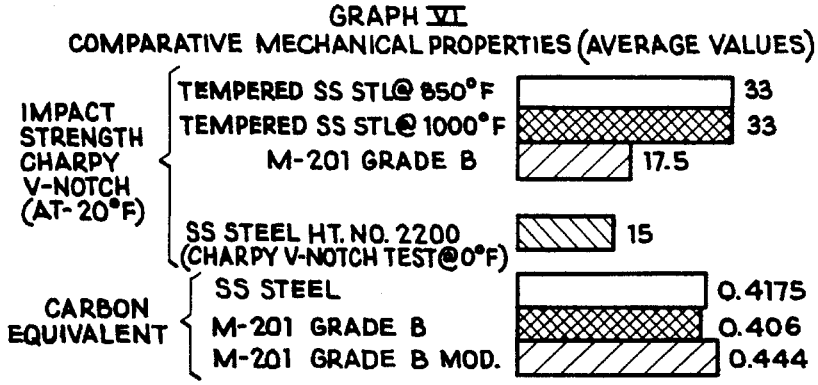
FIG. 6 is a bar graph illustration of the impact strength and carbon equivalent of alloys of the present invention and the standard AAR steel grade B material; and, FIG. 7 is a bar graph illustration of the mechanical properties of the several steel heats in FIG. 6.
Figure 7:
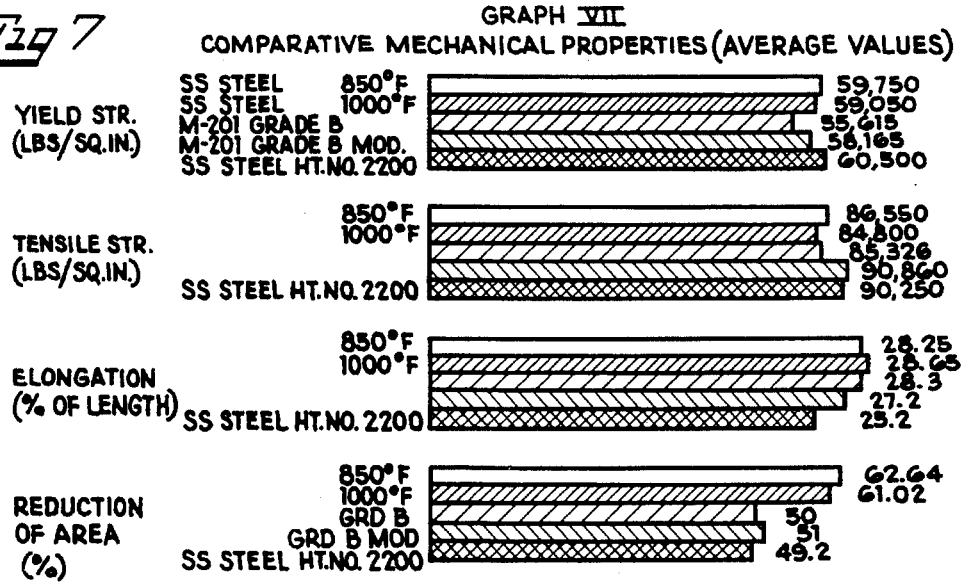

Toughness of a metal is its ability to absorb energy and deform plastically before fracturing. Although the area under the stress-strain curve in tensile testing is a measure of toughness, this characteristic is usually measured by the energy absorbed in a notch impact test, such as a Charpy V-notch test. The noted Charpy test is a standard test utilizing a pendelum-type apparatus where the energy absorbed by the test specimen from the falling pendelum, as measured by the rise of the pendelum, is a measure of impact strength or notch toughness. Charpy impact tests were conducted on the SS-steel cast samples from the heats listed in Table III for both the heat-treated, quenched and tempered, and the normalized and tempered materials. The test results are reported in Tables IV to X, which results are graphically illustrated in FIG. 5 along with the specification requirements for M-201 Grades B, C and E. The Charpy tests for the heat-treated, quenched and tempered materials were performed at –40° F. and these SS-steel impact-test results exceeded the Grade B requirements throughout the reported tempering temperature range. In addition, these SS-steel impact test results were above the requisite Grade C requirements for all tempering temperatures above 900° F. The impact tests for the normalized and tempered SS-steel samples were conducted at 0° F., and the reported average impact tests of Tables IX and X clearly exceeded the requirements for both Grades B and C in the reported tempering range, as shown in FIG. 5, Graph V.

As a further consideration of the toughness of the SS-steel, impact tests were reported for tests conducted at +20° F. for a plurality of sample test heats, which were tempered at 850° F. and 1000° F., as well as tests for production samples of a Grade B material. The Grade B data was reported from 73 production steel heats provided in normal service. These test results are noted in Bar Graph VI, which again demonstrates the improved notch toughness of the SS-steel and impliedly its expected improved inservice toughness. The noted heat number 2200 of SS-steel was cast at a manufacturing facility in a full-scale test and impact tests were conducted at 0° F. The test samples from heat number 2200 were heat treated and tempered at 1000° F. and as noted the impact results would meet the requirements of M-201 Grade B material. Therefore, the reported data and resultant evaluation confirms that the SS-steel material will meet or exceed the requisite mechanical property specifications of the AAR for M-201 Grade B steel.

As noted above, the carbon equivalent is a measure of the chemical material composition as an indicator of the effect of carbon content upon the mechanical properties and the weldability of the steel material. The carbon equivalent of the materials reported in FIG. 5, Graph VI, illustrates that the SS-steel exceeds the carbon equivalent value of the Grade B material presently provided for manufacturing applications. As a further illustration of the extraordinary steps taken to provide a material adequate to meet both the mechanical property requirements and the welding characteristics of the end users, a modified M-201 Grade B material has sometimes been provided by at least one supplier, which Grade B material meets the alloy material specifications noted above, but includes an addition of up to 0.05% chromium in the alloy. This latter alloy addition is within the chemical analysis specification and enhances the mechanical and weldment properties, but it is an uncompensated and costly addition to the manufacturer. The bar graph illustrations in FIG. 7, Graph VII demonstrate the improved mechanical properties of the SS-steel in comparison to the present industry standard M-201 Grade B material utilized for certain as-cast railroad-car part applications. The mechanical property improvements are clearly desirable, however it is these improvements in concert with the anticipated enhanced weldability that distinguishes the new SS-steel. Further, the attainment of these improvements in material properties without distortion of the manufacturing practices by introduction of the necessity to segregate charge materials to avoid scrap charge contamination has further enhanced the value and appreciation of this new material.

Early laboratory alloy heats showed that the microstructure of the alloy under investigation had a microstructure of tempered martensite with a small amount of bainite. This microstructure was noted in as-poured plate samples, which had been hardened at 1650° F. and tempered at 900° F., 950° F. and 1000° F.. There were no large variations in microstructures noted for the variations in tempering temperatures except for slight coarsening of the martensite needles at higher tempering temperatures. The material of the present invention has also shown improved impact strength or notch toughness over materials presently utilized to meet AAR specification M-201 for products. These presently utilized materials meeting the above-noted M-201 specification frequently have a carbon concentration at approximately 0.28 weight percent and a Charpy V-notch impact value at 20° F. of about 25 ft-lbs. However, the improved steel alloy material has a Charpy V-notch impact value at 20° F. of over 30 ft-lbs.. This Charpy impact value for an as-cast and normalized steel material is an important asset to the railway component manufacturer as the vehicles are susceptible to frequent impacts and to a broad range of operating conditions and temperatures. Thus the improved alloy is felt to enhance the safe operation of the railway cars.

Although an example of the utilization of the ferrous alloy material of the present invention was noted as a draft-sill end casting, this same material can be used in applications requiring high-strength, low to medium carbon content, good weldability, relatively high impact properties and relatively low cost, as compared to a high-alloy content material, as-cast ferrous material. In addition, usage of this improved alloy is not to be viewed as solely limited to railway car components, but can find use in applications with similar material requirements.

Those skilled in the art will recognize that certain variations can be made in the illustrative embodiment. While only specific embodiments of the invention have been described, it is apparent that various alternatives and modifications can be made therein. It is, therefore, the intention in the appended claims to cover all such modifications and alternatives as may fall within the true scope of the invention.

We claim:

1. A high-strength, fine-grained cast steel alloy with improved weldability for railway vehicle components with low hot-cracking sensitivity, said alloy consisting of 0.15% to 0.21% C, 0.90% to 1.30% Mn, 0.35% to 0.65% Si, 0.25% to 0.60% Cr, 0.10% to 0.30% Mo, a maximum of 0.025% of P, a maximum of 0.025% S and the balance being Fe with residual impurities.

2. A high-strength, fine-grained cast steel alloy with improved weldability for railway vehicle components as claimed in claim 1, wherein said alloy has a yield strength of at least 55,000 psi and a tensile strength of at least 80,000 psi.

3. A cast steel alloy for railway vehicle components as claimed in claim 2, wherein said alloy has an elongation in two inches of 24% and a reduction in area of 36%.

4. A cast steel alloy for railway vehicle components as claimed in claim 2, wherein said alloy has a Charpy V-notch value at 20 degrees Fahrenheit of 30 ft-lbs..

5. A cast steel alloy for railway vehicle components as claimed in claim 2, wherein said steel alloy has a carbon equivalent between about 0.34 and 0.44.

6. A cast steel alloy for railway vehicle components as claimed in claim 2, wherein said cast alloy material component is normalized to provide a more uniform alloy microstructure.

7. A high-strength, fine-grained cast steel alloy with improved weldability for railway vehicle components with low hot-cracking sensitivity, which steel alloy will provide the mechanical and physical properties of AAR specification M-201 (7.2.2), said alloy consisting of 0.15% to 0.21% C, 0.90% to 1.30% Mn, 0.35% to 0.65% Si, 0.25% to 0.60% Cr, 0.10% to 0.30% Mo, a maximum of 0.025% of P, a maximum of 0.025% S and the balance being Fe with residual impurities, which material has a yield strength of at least 55,000 psi and a tensile strength of at least 80,000 psi.

8. A cast steel alloy for railway vehicle components as claimed in claim 7, wherein said alloy has an elongation in two inches of 24% and a reduction in area of 36%.

9. A cast steel alloy for railway vehicle components as claimed in claim 7, wherein said steel alloy has a Charpy V-notch value at 20 degrees Fahrenheit of 30 ft-lbs..

10. A cast steel alloy for railway vehicle components as claimed in claim 7, wherein said steel alloy has a carbon equivalent between about 0.34 and 0.44.

11. A cast steel alloy for railway vehicle components as claimed in claim 7, wherein said cast steel alloy material component is normalized to provide a more uniform alloy microstructure.

* * * * *